US010099832B2

(12) United States Patent
Arning et al.

(10) Patent No.: US 10,099,832 B2
(45) Date of Patent: Oct. 16, 2018

(54) BAG FOR STORING AND PREPARING FOOD

(75) Inventors: Hans-Juergen Arning, Luebbecke (DE); Sven Larisch, Bas Oeynhausen (DE); Bjoern Hoeser, Minden (DE)

(73) Assignee: Cofresco Frischhalteprodukte GmbH & Co. KG, Minden (DE)

( * ) Notice: Subject to any disclaimer, the term of this patent is extended or adjusted under 35 U.S.C. 154(b) by 332 days.

(21) Appl. No.: 13/614,490

(22) Filed: Sep. 13, 2012

(65) Prior Publication Data

US 2013/0071049 A1 Mar. 21, 2013

(30) Foreign Application Priority Data

Sep. 15, 2011 (DE) ..... 20 2011 051 309 U

(51) Int. Cl.

| | |
|---|---|
| ***B65D 65/00*** | (2006.01) |
| ***B65D 65/42*** | (2006.01) |
| ***B65D 30/08*** | (2006.01) |
| ***B65D 81/34*** | (2006.01) |

(52) U.S. Cl.

CPC ..... *B65D 65/42* (2013.01); *B65D 31/02* (2013.01); *B65D 81/3407* (2013.01)

(58) Field of Classification Search

CPC ..... B65D 29/00; B65D 31/04; B65D 33/00; B65D 75/26; B65D 88/1612; B65D 33/02; B65D 31/10

USPC ..... 383/37–39, 107, 116, 109

See application file for complete search history.

(56) References Cited

U.S. PATENT DOCUMENTS

| | | | | |
|---|---|---|---|---|
| 3,807,626 A | | 4/1974 | Goodrich | |
| 3,891,775 A | * | 6/1975 | Murray | B65D 75/26 206/484 |
| 3,974,960 A | * | 8/1976 | Mitchell | B65D 33/165 206/813 |
| 4,176,746 A | * | 12/1979 | Kooi | 206/438 |
| 4,570,820 A | * | 2/1986 | Murphy | 221/34 |
| 4,571,337 A | | 2/1986 | Cage et al. | |
| 4,650,088 A | * | 3/1987 | Hirota | B65D 17/502 220/260 |
| 4,704,731 A | * | 11/1987 | Katase et al. | 383/120 |
| 4,806,398 A | * | 2/1989 | Martin, Jr. | B32B 27/10 156/244.11 |
| 4,826,011 A | * | 5/1989 | Jud | 206/484 |
| 4,927,647 A | * | 5/1990 | Bailey | A23G 3/34 264/45.4 |

(Continued)

FOREIGN PATENT DOCUMENTS

| | | |
|---|---|---|
| GB | 1371415 A | 10/1974 |
| GB | 1503913 A | 3/1978 |
| GB | 1508492 A | 4/1978 |

OTHER PUBLICATIONS

European Search Report of EP 12 18 4293 dated Jan. 7, 2013.

*Primary Examiner* — Peter Helvey

(74) *Attorney, Agent, or Firm* — FisherBroyles, LLP; Robert Kinberg

(57) ABSTRACT

A bag for storing and preparing food, includes a bag body including two sheets having edge regions and being sealed together at least partially along a plurality of the edge regions to present edge seals and a bag opening at one end of the bag. Each sheet comprises a composite material including a plastic inside layer suitable for making contact with the food and an outside layer of paper or metal foil.

15 Claims, 1 Drawing Sheet

(56) References Cited

U.S. PATENT DOCUMENTS

| | | | | |
|---|---|---|---|---|
| 4,942,809 | A * | 7/1990 | Simmons | A47J 43/18 383/117 |
| 5,178,469 | A | 1/1993 | Collinson | |
| 5,184,771 | A * | 2/1993 | Jud | B65D 75/5844 206/524.2 |
| 5,542,529 | A * | 8/1996 | Hein, III | B65D 85/1018 206/245 |
| 5,827,586 | A * | 10/1998 | Yamashita et al. | 428/36.6 |
| 5,968,616 | A * | 10/1999 | Kakemura | B29C 49/24 215/12.1 |
| 6,312,742 | B1 * | 11/2001 | Wood et al. | 426/122 |
| 6,719,140 | B1 | 4/2004 | Rinsler | |
| 6,964,520 | B1 * | 11/2005 | Sakai et al. | 383/207 |
| 7,108,650 | B2 * | 9/2006 | Marzano | 493/204 |
| 2004/0252921 | A1 * | 12/2004 | Winiarski | B65D 33/165 383/207 |
| 2006/0072861 | A1 * | 4/2006 | Oshima | B65D 75/5805 383/200 |
| 2006/0177162 | A1 * | 8/2006 | Harano et al. | 383/202 |
| 2006/0222271 | A1 * | 10/2006 | Yoffe | 383/102 |
| 2007/0047853 | A1 * | 3/2007 | Sharp et al. | 383/106 |
| 2007/0292053 | A1 * | 12/2007 | Lin et al. | 383/78 |
| 2008/0128413 | A1 * | 6/2008 | Garcia | A01K 1/0125 220/6 |
| 2008/0247683 | A1 * | 10/2008 | Schmal | B65D 33/18 383/104 |
| 2009/0035424 | A1 * | 2/2009 | Mita et al. | 426/113 |
| 2009/0263049 | A1 * | 10/2009 | Iannelli et al. | 383/64 |
| 2010/0178394 | A1 * | 7/2010 | Exner et al. | 426/127 |
| 2010/0189380 | A1 * | 7/2010 | Sargin et al. | 383/94 |

* cited by examiner

BAG FOR STORING AND PREPARING FOOD

CROSS-REFERENCE TO RELATED APPLICATION

This application claims the priority of German Patent Application No. 20 2011 051 309.2, filed on Sep. 15, 2011, the subject matter of which is incorporated herein by reference.

BACKGROUND OF THE INVENTION

The present invention relates to a bag for storing and preparing food which comprises a bag body composed of two sheets, wherein these sheets are glued together or welded together along the edges, at least in part along the seams, and wherein an opening is embodied on one edge which functions as the bag opening.

Bags composed of a plastic film, in particular of thermo-fixed PET (polyethylene terephthalate) or a special polyamide, are available for use as roasting bags and are embodied smooth and non-adhering on the inside. To close these bags, the bag opening must be sealed with a separate closure, for example with a clip or a clamp. Traditional, bi-axially oriented and thermo-fixed bags of PET film cannot be sealed with heated sealing bars, but require an additional sealing layer. These types of bags are for the most part produced with the separation welding process which is the reason why a production of these bags on a roll is not possible since the webs must be cut continuously.

Bags composed of polyamide are furthermore relatively stiff, become softer by absorbing water and are therefore less suitable for freezing because they can adhere to the frozen good. If these bags are used as roasting bags, the bags must be perforated by the user, for example by cutting them with scissors, so as to prevent an accidental bursting as a result of the inside pressure that forms during the heating process.

SUMMARY OF THE INVENTION

It is therefore an object of the present invention to create a bag for storing and preparing food, which can be produced easily and ensures an optimum handling.

The above and other objects of the invention are achieved by the provision of a bag for storing and preparing food which, according to one embodiment, comprises: a bag body including two sheets having edge regions and being sealed together at least partially along a plurality of the edge regions to present edge seals and a bag opening end of the bag, wherein each sheet comprises a composite material including a plastic inside layer suitable for making contact with the food and an outside layer comprised of at least one of paper and a metal foil.

According to the invention, the sheets of the body of the bag are composed of a composite material, comprising a plastic inside layer that is suitable for the contact with food and an outside layer of paper and/or a metal foil. In contrast to a pure aluminum foil, the inside is therefore acid-resistant and corrosion-resistant. However, the composite material is malleable because of the outside layer of paper and/or a metal foil, meaning the user can deform the material so that it mostly retains the deformed shape. This feature can be utilized to obtain for the most part a tight seal of the bag opening, either by turning it inward, folding it or crimping it, so that the bag can be used as roasting bag. The composite material can furthermore be processed easily since, surprisingly, it has turned out that the composite material, for example composed of aluminum and biaxial-oriented PET, can be heat-sealed. Bags having sealed edges with an optional number of seams can thus be produced on conventional bag-manufacturing machines, either on a roll or in the form of individual bags.

According to one embodiment, the inside layer is glued to the outside layer, thereby securely avoiding a separation of the inside layer from the outside layer.

A temperature-resistant plastic melt can furthermore be applied directly for the inside layer, for example with the aid of the extrusion-coating technique. The use of an adhesive is then no longer required.

The composite material may be heat-resistant up to 200° C., in particular up to 220° C., so that it can also be used as a roasting bag, thereby making it possible to use the bag for cooking food in an oven.

An aluminum foil which is easily foldable and has good plasticity may be used for the outside layer. The thickness of the outside layer in that case can range from 2 μm to 20 μm, in particular from 5 μm to 10 μm.

A plastic film serves as the inside layer of the composite material, preferably PTFE (polytetrafluoroethylene), PET (polyethylene terephthalate), PSU (polysulfone), PMP (polymethylpentene), PEEK (polyether ether ketone) and/or PA (polyamide). Other plastic materials suitable for the contact with foods can also be used. The inside layer may have a thickness of 2 μm to 15 μm, and preferably 3 μm to 7 μm, wherein the inside layer can be embodied thinner than the outside layer.

The seal strength of the bag preferably exceeds more than 4N/cm. As a result, a tear-resistant bag is produced which can be used easily for household purposes.

The composite material may be embodied to be foldable. In this connection, foldable means that the ductility is such that following a folding of the composite material, the material essentially remains in a folded position and does not rebound elastically to the starting position.

According to a different embodiment of the invention, the inside layer may be coated on the side facing toward the inside with a non-stick agent, in particular silicone. As a result, the adherence of the composite material to the food is avoided during the freezing or cooking.

According to an alternative embodiment, the outside layer consists of paper which can have a mass per unit area ranging from 10 g/m 50 g/m$^2$. The use of paper allows printing or affixing a graphic design as desired to the outside.

BRIEF DESCRIPTION OF THE DRAWINGS

These and other features and advantages of the invention will be further understood from the following detailed description with reference to the accompanying drawings, showing in.

DETAILED DESCRIPTION

Figure 1:
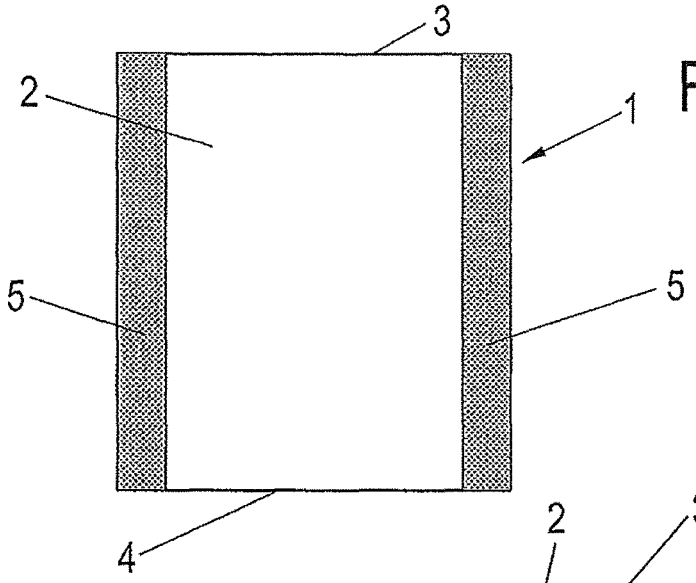
FIG. 1, a view of a bag according to the invention, provided with a bottom fold.

FIG. 1 illustrates a bag 1 consisting of a bag body composed of two sheets, positioned one above the other, which are joined along opposite-arranged longitudinal edge regions with the aid of a strip-type sealing layer 5. A bottom fold 4 that joins the two sheets is provided at one end edge. An opening 3 for filling the bag 1 is embodied on the opposite end edge the bottom fold 4.

Figure 2:
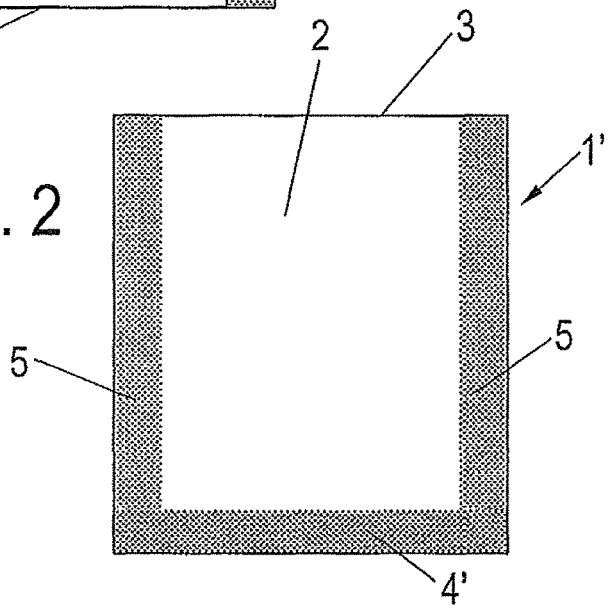
FIG. 2, a view of a bag according to the invention with a sealing edge.

In place of the bottom fold 4, the bag 1' shown in FIG. 2 is provided with an additional sealing-edge edge 4' in the bottom region, so that the two sheets are connected to each other along the edges on three sides with strip-type sealing edges 4' and 5.

Figure 3:
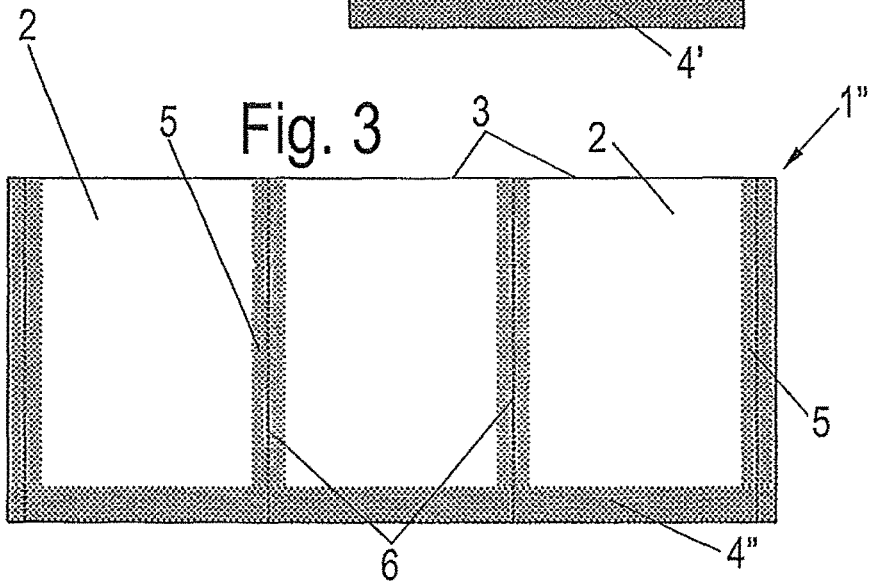
FIG. 3, a view of a web composed of several bags according to the invention.

FIG. 3 shows several bags 1" which are connected to each other and respectively consist of a bag body 2, having two sheets which are joined via edge seals 5 along the longitudinal side edges and a sealing edge 4" in the bottom region, wherein the sheets are embodied open at a bag opening 3. Two adjacent bag bodies 2 are connected by a perforation in the region of a longitudinal seal edge 5 and can be separated by tearing along this perforation 6. As a result, the bags 1" can be wound onto a roll and can be torn off by the user.

The sheets of the bags 1, l' and 1" respectively consist of a composite material of two layers, wherein the inside layer consists of a plastic film which is permanently joined to an outside layer, for example by gluing them together. The outside layer consists of a metal foil, in particular aluminum foil, with a thickness ranging from 2 μm to 20 μm and especially from 5 μm to 10 μm. The outside layer can furthermore also consist of paper in place of the metal foil, wherein the paper may be permanently joined to the plastic film. In addition, the sheet of composite material can also comprise more than two layers.

Any type of adhesive can be used which is suitable for joining the plastic film to the outside layer, so that a stable connection is obtained between the inside layer and the outside layer, given the thermal and mechanical conditions to be expected. Two-component or multi-component systems or hot melt can be used. A polyurethane adhesive can be used in particular which is applied, for example, in amounts ranging from 2 $g/m^2$ to 5 $g/m^2$.

The inside layer of plastic material is suitable for the contact with food and is preferably heat-resistant up to a temperature of 220° C. The inside layer in this case can have a thickness ranging from 2 μm to 15 μm, in particular 3 μm to 7 μm, and can thus be thinner than the outside layer. The plastic film in particular can consist of PTFE (polytetrafluoroethylene), PET (polyethylene terephthalate), PSU (poly sulfon), PEEK (polyether ether ketone), PMP (polymethyl pentene), PA (polyamide) or any other suitable plastic material or a mixture of the aforementioned materials. In addition, it is possible to coat the inside layer with a non-stick coating, for example with silicone, to avoid the adhering to food items.

Owing to the fact that the inside layer is embodied thin, the composite material can be deformed and folded easily, so that the composite material can snugly enclose the filler material inside the bag 1, 1' and 1". The user can furthermore easily close the bag 1, 1', 1" by folding it, turning it over or crimping the bag opening 3.

The composite material furthermore has sufficient mechanical stability at freezing temperatures of up to −20° C., and the bags 1, 1', 1" containing the food items can be taken from the freezer and placed directly into the oven, so as to heat up the bags 1, 1', 1" therein.

For the embodiments shown herein, the bag 1, 1', 1" is shown to have a smooth bag opening 3 where the two sheets with identical dimensions are designed to be placed precisely one on top of the other. Of course, it is also possible to embody one sheet of the body 2 to be longer than the other one, thereby allowing it to be folded over the other sheet in the manner of a loop.

The composite material bag can furthermore be embodied for the most part to have an optional shape and size and can thus be used for different applications.

It will be understood that the above description of the present invention is susceptible to various modifications, changes and adaptations, and the same are intended to be comprehended within the meaning and range of equivalents of the appended claims.

What is claimed is:

1. A bag for storing and preparing food, comprising:

a bag body including two sheets having edge regions and being sealed together at least partially along a plurality of the edge regions to present edge seals and a bag opening at one end of the bag, wherein each sheet comprises a composite material consisting of a plastic inside layer suitable for making contact with the food, an outside layer consisting of paper or a metal foil, and glue sealing the inside layer to the outside layer, wherein the inside layer comprises at least one of PTFE, biaxial-oriented PET, PSU, PMP, PEEK and PA; and wherein the composite material is heat resistant up to at least 200° C.

2. A bag for storing and preparing food, comprising:

a bag body including two sheets having edge regions and being sealed together at least partially along a plurality of the edge regions to present edge seals and a bag opening at one end of the bag, wherein each sheet comprises a composite material consisting of a plastic inside layer suitable for making contact with the food, an outside layer consisting of paper or a metal foil, and a hot melt coating or an extruded coating sealing the inside layer to the outside layer, wherein the inside layer comprises at least one of PTFE, biaxial-oriented PET, PSU, PMP, PEEK and PA.

3. The bag according to claim 1, wherein the composite material is heat resistant up to at least 220° C.

4. The bag according to claim 1, wherein the outside layer is an aluminum foil.

5. The bag according to claim 1, wherein the outside layer has a thickness of between 2 μm and 20 μm.

6. The bag according to claim 1, wherein the outside layer has a thickness of between 5 μm to 10 μm.

7. The bag according to claim 1, wherein the inside layer has a thickness ranging from 2 μm and 15 μm.

8. The bag according to claim 1, wherein the inside layer has a thickness ranging from 2 μm to 7 μm.

9. The bag according to claim 1, wherein the edge seals have a strength greater than 4 N/cm.

10. The bag according to claim 1, wherein the composite material is foldable.

11. The bag according to claim 1, wherein the glue is a polyurethane adhesive between the inside layer and the outside layer.

12. The bag according to claim 1, wherein the composite material further consists of a coating of a non-adhesive material on the inside layer on a side facing toward an inside of the bag.

13. The bag according to claim 12, wherein the non-adhesive material comprises silicone.

14. The bag according to claim 1, wherein the outside layer is paper.

15. The bag according to claim 14, wherein the paper has a mass per square unit area ranging from 10 to 50 $g/m^2$.

* * * * *